US008172223B2

(12) United States Patent
Nishinakama

(10) Patent No.: US 8,172,223 B2
(45) Date of Patent: May 8, 2012

(54) SHEET FEEDING APPARATUS, IMAGE FORMING APPARATUS, AND IMAGE READING APPARATUS WITH AN ABUTMENT MEMBER ON A MOVABLE GUIDE

(75) Inventor: Hideki Nishinakama, Higashiosaka (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/854,006

(22) Filed: Aug. 10, 2010

(65) Prior Publication Data

US 2011/0038658 A1 Feb. 17, 2011

(30) Foreign Application Priority Data

Aug. 11, 2009 (JP) ..... 2009-186815

(51) Int. Cl.
*B65H 1/00* (2006.01)

(52) U.S. Cl. ..... 271/171; 271/169

(58) Field of Classification Search ..... 271/169, 271/171, 124, 125, 241
See application file for complete search history.

(56) References Cited

U.S. PATENT DOCUMENTS

| | | | | |
|---|---|---|---|---|
| 6,724,506 | B1 * | 4/2004 | Wang | 271/117 |
| 2005/0110206 | A1 * | 5/2005 | Hsieh | 271/117 |
| 2008/0315499 | A1 * | 12/2008 | Murrell | 271/109 |

FOREIGN PATENT DOCUMENTS

| | | | |
|---|---|---|---|
| JP | 08-301473 | | 11/1996 |
| JP | 08301473 | A * | 11/1996 |
| JP | 09-323840 | | 12/1997 |
| JP | 2001-080761 | | 3/2001 |
| JP | 2001080761 | A * | 3/2001 |
| JP | 2004-345797 | | 12/2004 |

* cited by examiner

*Primary Examiner* — Gerald McClain
(74) *Attorney, Agent, or Firm* — Workman Nydegger

(57) ABSTRACT

A sheet feeding apparatus includes a placement surface on which a sheet to be transported is placed; a fixed guide which abuts against one side edge of the sheet; a movable guide which abuts against the other side edge of the sheet; a sheet feeding roller which abuts against a surface of the sheet at a position which is at the side of the fixed guide; an abutment member which is provided on the movable guide. The abutment member has a side surface opposed to the fixed guide in the width direction, and the side surface is formed into a slant shape such that as a portion of the side surface is nearer to the fixed guide in the width direction, a distance between the portion of the side surface and the placement surface is increased.

21 Claims, 15 Drawing Sheets

SHEET FEEDING APPARATUS, IMAGE FORMING APPARATUS, AND IMAGE READING APPARATUS WITH AN ABUTMENT MEMBER ON A MOVABLE GUIDE

BACKGROUND

1. Technical Field

The present invention relates to a sheet feeding apparatus used for automatically transporting a sheet, and an image forming apparatus and an image reading apparatus which include the sheet feeding apparatus.

2. Related Art

In general, an image forming apparatus such as a printer and an image reading apparatus such as a scanner include a sheet feeding apparatus which supplies a sheet from a placement surface of a sheet feeding tray to an image forming portion or an image reading portion. The sheet feeding apparatus includes a sheet feeding roller which abuts against a sheet and rotationally drives for automatically supplying the sheet placed on the placement surface.

Further, as is known, a sheet feeding apparatus generally includes an edge guide which abuts against a side edge of a sheet in the width direction to guide transport of the sheet. The edge guide includes a fixed guide and a movable guide so as to guide transport of a sheet depending on various kinds of sheet sizes.

Further, there is disclosed a sheet feeding apparatus on which a sheet feeding roller is arranged so as to abut against a surface of a sheet at the fixed guide side (see JP-A-2001-80761, for example).

In JP-A-2001-80761, a support axis to which a pickup unit is attached is supported on one side plate with a cantilever structure. To be more specific, in the sheet feeding apparatus disclosed in JP-A-2001-80761, a pickup unit is attached to a top end of the support axis extending from a fixed guide (side plate), and a sheet feeding roller is rotatably arranged on the top end of the pickup unit. With such a configuration, the sheet is transported while a surface of the sheet is pressed on the side where the fixed guide is located by the sheet feeding roller.

In the sheet feeding apparatus including the sheet feeding roller which abuts against a surface of a sheet at the fixed guide side and rotationally drives, the sheet has been transported in a state in which the sheet is tilted relative to the transport direction in some case. To be more specific, a force of transporting a sheet P is generated on one edge side of the sheet P in the width direction by a sheet feeding roller 8 located at the side of a fixed guide 6*a* as shown in FIG. 17 and FIG. 18. The sheet feeding roller 125 abuts against a surface of the sheet P and rotationally drives. However, when a sheet P having high elasticity such as cardboard or the like is transported, the other edge of the sheet P (that is, the side of a movable guide 23) where the sheet feeding roller 8 is not provided is lifted off from a placement surface 4 during transport of the sheet P in some case. There is a disadvantage that the sheet P is transported in a state in which the sheet P is tilted relative to the transport direction by a sheet feeding apparatus 102, if the sheet P is lifted off as described above.

In order to avoid such a disadvantage, it can be considered that an abutment member which abuts against a surface of a sheet is also provided on the side of the movable guide as in the same manner as the sheet feeding roller. Further, it can be considered that the abutment member which abuts against the surface of the sheet at the side of the movable guide is biased toward a placement surface by an elastic member, thus the surface of the sheet can be effectively pressed at the side of the movable guide by the abutment member.

However, in a case where the abutment member is biased toward the placement surface, when a sheet is to be placed on the placement surface, the sheet needs to be inserted between the placement surface and the abutment member. In such a case, when the sheet is set between the fixed guide and the movable guide and then the movable guide is moved so as to abut against the side edge of the sheet, the sheet inserted from the side of the fixed guide is interfered with the side surface of the abutment member provided on the movable guide in some case. Therefore, the sheet cannot be easily placed on the placement surface against which the abutment member is pressed.

SUMMARY

An advantage of some aspects of the invention is to provide a sheet feeding apparatus capable of suppressing a sheet from being transported in a state in which the sheet is tilted relative to the transport direction and easily placing the sheet on a placement surface, an image forming apparatus and an image reading apparatus.

A sheet feeding apparatus according to an aspect of the invention includes a placement surface on which a sheet to be transported is placed, a fixed guide which abuts against one side edge of the sheet in the width direction to guide transport of the sheet, a movable guide which abuts against the other side edge of the sheet in the width direction to guide transport of the sheet while a distance between the movable guide and the fixed guide in the width direction of the sheet can be adjusted, a sheet feeding roller which abuts against a surface of the sheet at a position which is at the side of the fixed guide between the fixed guide and the movable guide and rotationally drives to transport the sheet, an abutment member which is provided on the movable guide and abuts against the surface of the sheet, and an elastic member which biases the abutment member toward the placement surface. In the sheet feeding apparatus, the abutment member has a side surface opposed to the fixed guide in the width direction, and the side surface is formed into a slant shape such that as a portion of the side surface is nearer to the fixed guide in the width direction, a distance between the portion of the side surface and the placement surface is increased.

According to the aspect of the invention, the sheet feeding apparatus includes the abutment member which is provided on the movable guide and abuts against a surface of a sheet and the elastic member which biases the abutment member toward the placement surface. Therefore, the surface of the sheet can be pressed not only by the sheet feeding roller located at the side of the fixed guide but also by the abutment member located at the side of the movable guide. Accordingly, even when a thick sheet having high elasticity is transported, both edges of the sheet in the width direction can be suppressed from lifting off. In addition, the sheet can be suppressed from being transported in a state in which the sheet is tilted relative to the transport direction. The side surface of the abutment member opposed to the fixed guide in the width direction is formed into a slant shape such that as a portion of the side surface is nearer to the fixed guide in the width direction, a distance between the portion of the side surface and the placement surface is progressively increased. Therefore, when a sheet is to be placed on the placement surface where the abutment member is biased, the sheet can be easily inserted between the placement surface and the abutment member along the side surface of the abutment member from the side of the fixed guide. Accordingly, even when the abutment member is biased toward the placement surface, the sheet inserted from the side of the fixed guide and the side surface of the abutment member can be suppressed from being interfered with each other. Thus, the sheet can be easily placed on the placement surface.

In the sheet feeding apparatus according to the aspect of the invention, it is preferable that the abutment member be a rotatable roller, and the side surface be formed with a convex-spherical surface of the roller of which the diameter is progressively smaller toward the side of the fixed guide.

According to the aspect of the invention, the sheet can be easily inserted between the placement surface and the roller along the convex-spherical surface of the roller. The diameter of the convex-spherical surface of the roller is progressively smaller toward the side of the fixed guide from the side of the movable guide. Further, friction impeding the transport of the sheet due to the abutment member can be suppressed from being generated because the abutment member is the rotatable roller.

The sheet feeding apparatus according to the aspect of the invention further includes a support member which rotatably supports the abutment member with respect to the movable guide and the abutment member is biased together with the support member toward the placement surface.

According to the aspect of the invention, the abutment member is biased together with the support member which rotatably supports the abutment member toward the placement surface. Therefore, it is sufficient that the movable guide for biasing the abutment member toward the placement surface has a configuration for rotatably supporting the support member. For example, it is sufficient that the movable guide has an axis support portion which supports a rotation axis provided on the support member. Accordingly, a configuration which directly supports the abutment member is not required to be formed on the movable guide.

In the sheet feeding apparatus according to the aspect of the invention, it is preferable that the support member have a side surface opposed to the fixed guide in the width direction, and the side surface be formed into a slant shape such that as a portion of the side surface is nearer to the fixed guide in the width direction, a distance between the portion of the side surface and the placement surface is progressively increased.

According to the aspect of the invention, the side surface of the support member opposed to the fixed guide in the width direction is formed into a slant shape such that as a portion of the side surface is nearer to the fixed guide in the width direction, a distance between the portion of the side surface and the placement surface is progressively increased. Therefore, when the sheet is inserted between the placement surface and the abutment member, the sheet can be guided between the placement surface and the abutment member along the side surface of the support member from the side of the fixed guide.

In the sheet feeding apparatus according to the aspect of the invention, it is preferable that the side surface of the support member be extendedly arranged so as to project progressively to the side of the fixed guide from the downstream side toward the upstream side in the transport direction of the sheet. According to the aspect of the invention, the side surface of the support member is extendedly arranged so as to project progressively to the side of the fixed guide from the downstream side toward the upstream side in the transport direction of the sheet. Therefore, the sheet can be reliably guided between the placement surface and the abutment member in comparison with a case where the side surface of the support member is extended in the transport direction in parallel.

In the sheet feeding apparatus according to the aspect of the invention, it is preferable that the support member have a bottom surface provided so as to face the placement surface, and an upstream side end surface which is provided on the upstream side in the transport direction of the sheet, and the upstream side end surface be connected to the bottom surface in a curvature manner.

According to the aspect of the invention, the upstream side end surface provided on the upstream side in the transport direction of the sheet is connected to the bottom surface provided so as to face the placement surface in a curvature manner. Therefore, the sheet can be easily inserted between the placement surface and the support member from the upstream side of the support member in the transport direction.

In the sheet feeding apparatus according to the aspect of the invention, it is preferable that the elastic member be a torsion coil spring attached to the movable guide. According to the aspect of the invention, since the elastic member is the torsion coil spring attached to the movable guide, the abutment member can be biased toward the placement surface by utilizing a torsion moment of the torsion coil spring.

An image forming apparatus according to another aspect of the invention includes the sheet feeding apparatus having the above configuration, and an image forming portion which forms an image on the sheet. According to the aspect of the invention, the image forming apparatus includes the sheet feeding apparatus having the above configuration and an image forming portion which forms an image on the sheet, accordingly, the same effects as described above can be obtained. Further, the sheet can be suppressed from being transported in a state in which the sheet is tilted relative to the transport direction so that the image is appropriately formed on the sheet.

An image reading apparatus according to another aspect of the invention includes the sheet feeding apparatus having the above configuration, and an image reading portion which reads an image formed on the sheet. According to the aspect of the invention, the image reading apparatus includes the sheet feeding apparatus having the above configuration and an image reading portion which reads an image formed on the sheet. Therefore, the same effects as described above can be obtained. Further, the sheet can be suppressed from being transported in a state in which the sheet is tilted relative to the transport direction so that the image formed on the sheet is appropriately read.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, one embodiment which embodies the invention will be described with reference to drawings.

Figure 1:
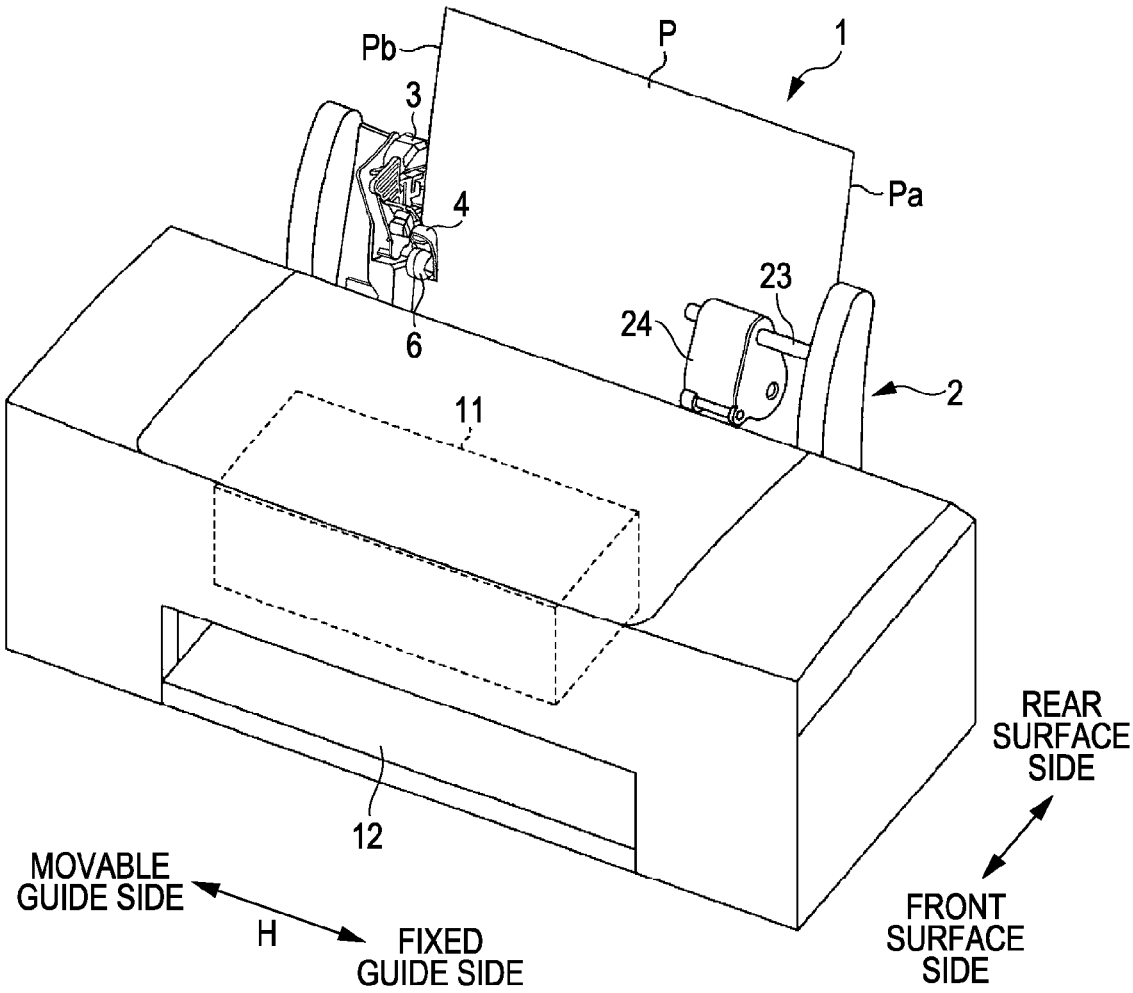
FIG. 1 is a perspective view illustrating an image forming apparatus according to an embodiment of the invention.

As shown in FIG. 1, a printer 1 as an image forming apparatus according to the embodiment is a recording apparatus which forms and records an image on a sheet P supplied from a rear surface side. Note that an arrow H in FIG. 1 indicates a width direction perpendicular to a direction in which the sheet P is transported (that is, a transport direction).

The printer 1 includes a sheet feeding apparatus 2 which is an Auto Sheet Feeder (ASF), an image forming portion 11 and a sheet discharge port 12. The image forming portion 11 forms an image on the sheet P supplied by the sheet feeding apparatus 2. The sheet P on which an image has been formed by the image forming portion 11 is discharged from the sheet discharge port 12. Side edges Pa, Pb of the sheet P to be transported by the sheet feeding apparatus 2 are guided by a pair of edge guides in the width direction H.

Figure 2:
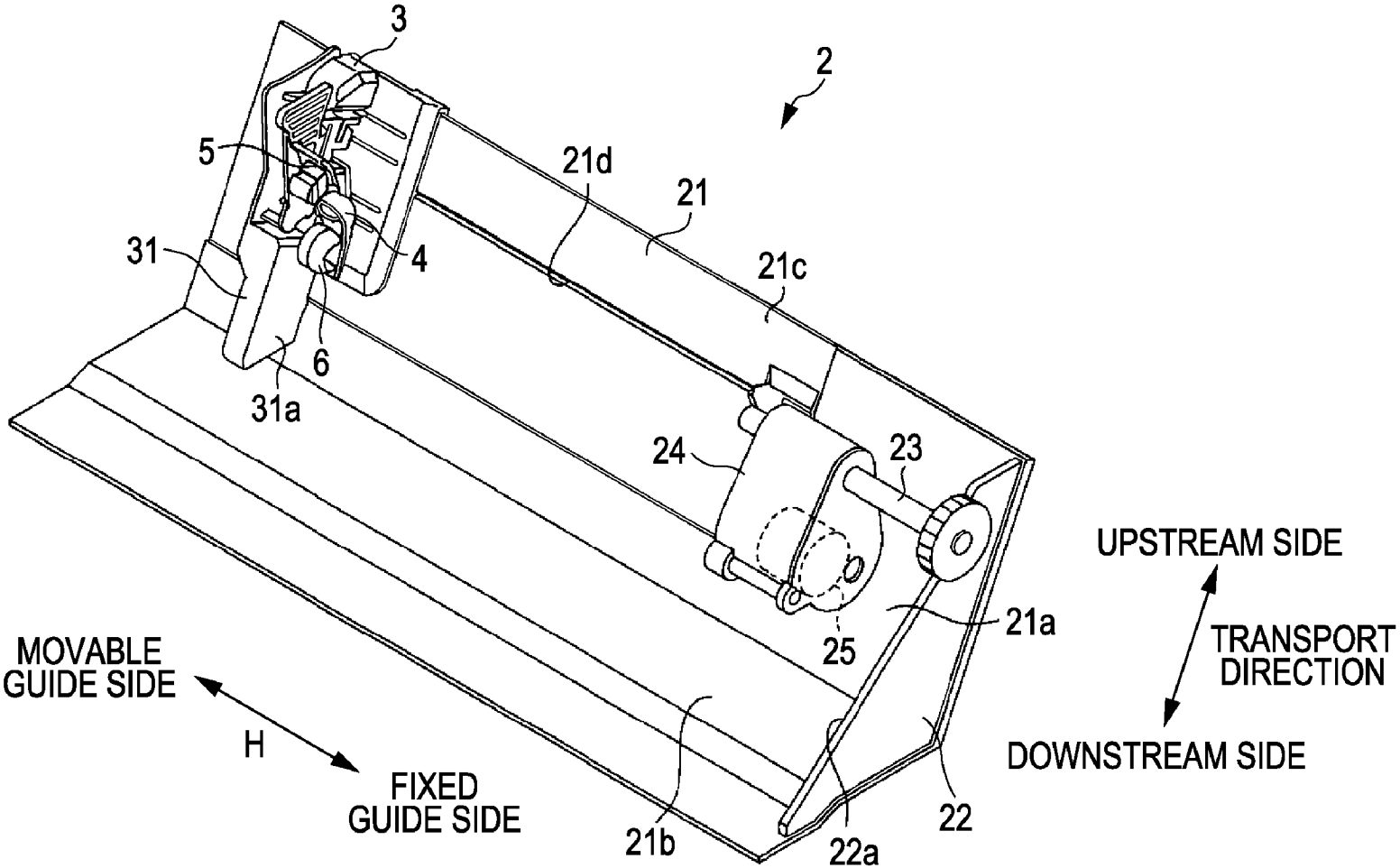
FIG. 2 is a perspective view illustrating a sheet feeding apparatus according to the embodiment.
Figure 3:
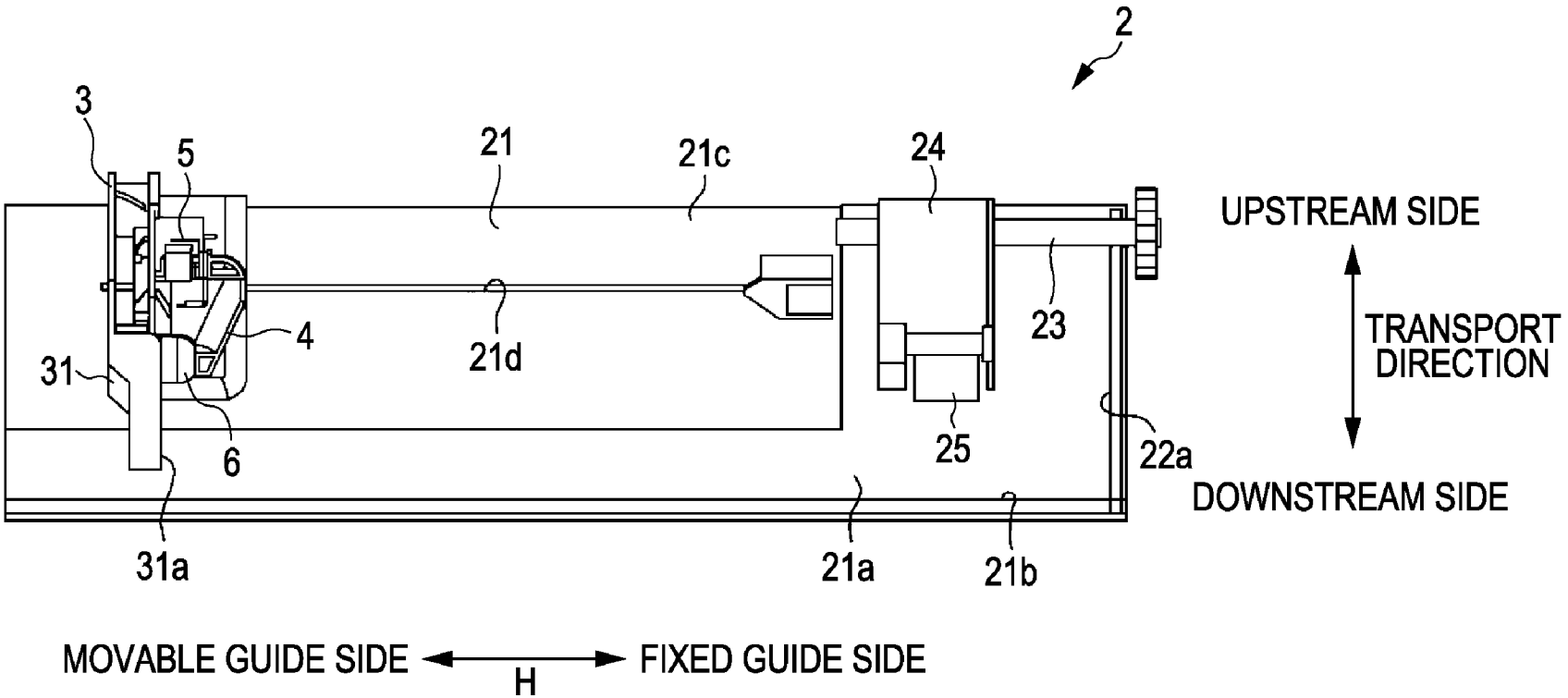
FIG. 3 is a front view illustrating the sheet feeding apparatus according to the embodiment.

As shown in FIG. 2 and FIG. 3, the sheet feeding apparatus 2 includes a sheet feeding tray 21, a fixed guide 22, a support axis 23, a pickup unit 24 and a sheet feeding roller 25. The sheet feeding tray 21 receives the sheet P. The fixed guide 22 is fixed to the sheet feeding tray 21. The support axis 23 is connected to an electric motor (not shown). The pickup unit 24 is supported by the support axis 23. The sheet feeding roller 25 is provided on a lower end of the pickup unit 24.

The sheet feeding tray 21 has a slanted placement surface 21*a* on which the sheet P is placed, and a substantially horizontal support surface 21*b* which supports a lower edge of the sheet P in a state in which the sheet P is placed slantingly on the placement surface 21*a*. Further, the sheet feeding tray 21 has a sliding contact surface 21*c* formed such that a part of the placement surface 21*a* is recessed. A groove 21*d* is extendedly arranged in the width direction H on the sliding contact surface 21*c*.

The fixed guide 22 is an edge guide which abuts against one side edge Pa of the sheet P in the width direction H to guide transport of the sheet P. The fixed guide 22 is provided on one edge of the sheet feeding tray 21 in the width direction H. The fixed guide 22 has a guide surface 22*a* which is extendedly arranged in the transport direction and is perpendicular to the placement surface 21*a*. Therefore, the sheet P is transported while the side edge Pa of the sheet P abuts against the guide surface 22*a*. This makes it possible to suppress the sheet P from being transported in a state in which the sheet P is tilted with respect to the transport direction.

The support axis 23 is provided so as to project from the fixed guide 22. A gear (not shown) is provided in the pickup unit 24 provided on a top end of the support axis 23. The gear transmits the rotation of the support axis 23 to the sheet feeding roller 25.

The sheet feeding roller 25 is a rotational member made of rubber, which abuts against a sheet surface (that is, a surface of the sheet P) at the side of the fixed guide 22 and rotationally drives. The sheet feeding roller 25 is provided on a lower end of the pickup unit 24. The sheet feeding roller 25 is biased together with the pickup unit 24 toward the placement surface 21*a*. When the support axis 23 is rotated by driving the electric motor, the sheet feeding roller 25 rotates. Accordingly, the sheet P against which the sheet feeding roller 25 abuts is transported from an upstream side to a downstream side in the transport direction by driving the electric motor, the electric motor being driven in a state where the sheet P is placed on the placement surface 21*a*.

The sheet feeding apparatus 2 includes a movable guide 3, a support member 4, a torsion coil spring 5 and an abutment roller 6. A distance between the fixed guide 22 and the movable guide 3 in the width direction H of the sheet P can be adjusted by moving the movable guide 3. The support member 4 is provided on the movable guide 3. The torsion coil spring 5 is attached to the movable guide 3 and the support member 4. The abutment roller 6 is rotatably supported by the support member 4.

Figure 4:
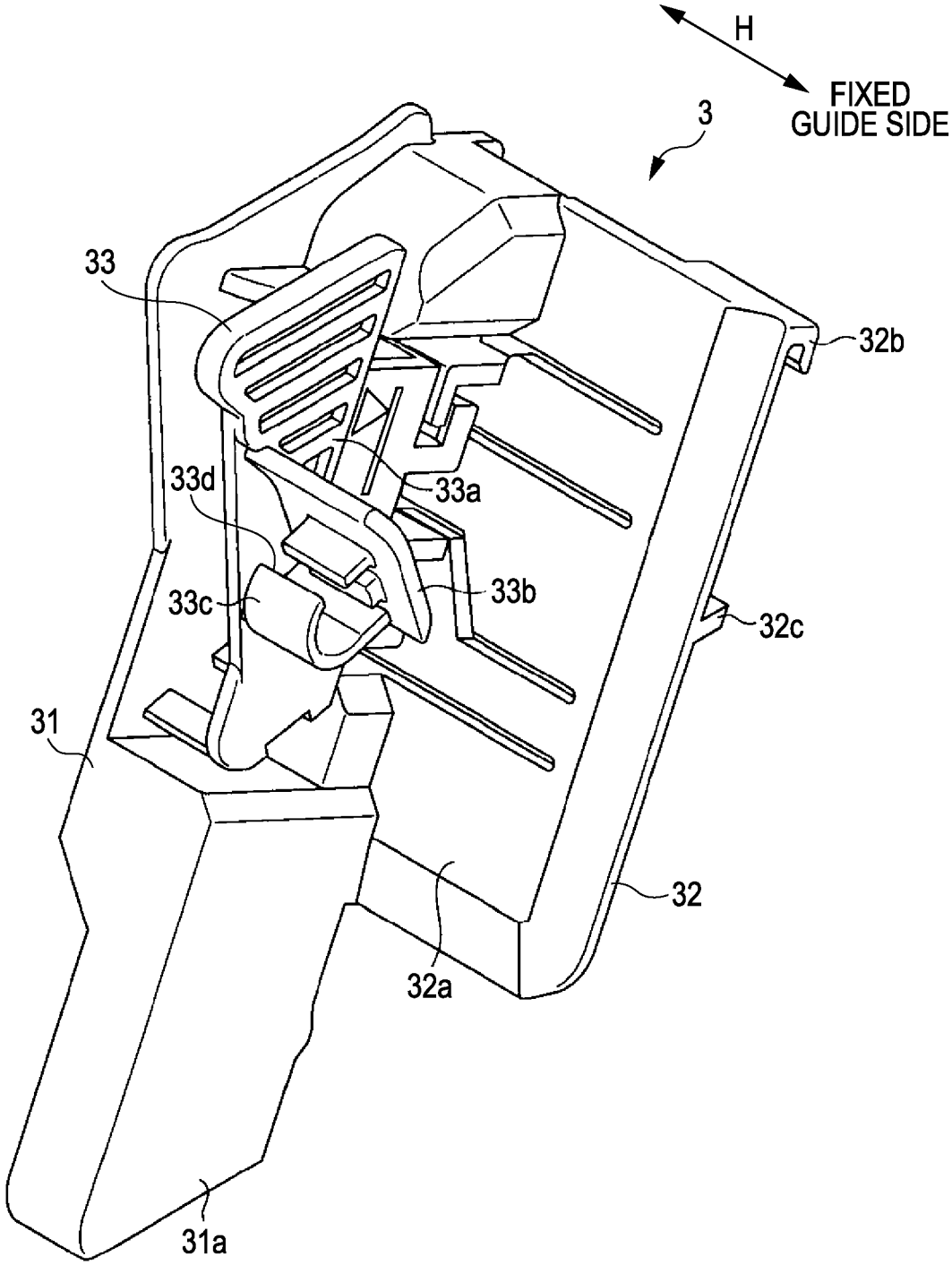
FIG. 4 is a perspective view illustrating a movable guide according to the embodiment.

As shown in FIG. 4, the movable guide 3 is an edge guide which abuts against the other side edge Pb of the sheet P in the width direction H and guides transport of the sheet P. The movable guide 3 is provided on the sheet feeding tray 21 such that a distance between the fixed guide 22 and the movable guide 3 can be adjusted. The movable guide 3 includes a main guide body 31, a sliding portion 32 and an operation portion 33. The main guide body 31 is arranged in a standing manner with respect to the placement surface 21*a*. The sliding portion 32 moves in a sliding contact manner on the sliding contact surface 21*c*. The operation portion 33 can be pressed with a finger tip for moving the movable guide 3. The movable guide 3 in which the main guide body 31, the sliding portion 32 and the operation portion 33 are integrally formed is configured of a single member made of a hard synthetic resin.

The main guide body 31 has a guide surface 31*a* which is extendedly arranged in the transport direction and is perpendicular to the placement surface 21*a*. The sheet P is transported while the side edge Pb of the sheet P abuts against the guide surface 31*a*. This makes it possible to suppress the sheet P from being transported in a state in which the sheet P is tilted with respect to the transport direction in comparison with a case where only one side edge Pa of the sheet P abuts against the edge guide.

The sliding portion 32 has a placement surface 32*a* on which a sheet to be transported is placed. The placement surface 32*a* is a surface which is parallel to the placement surface 21*a* of the sheet feeding tray 21 and perpendicular to the guide surface 31*a*. A locking hook 32*b* and a convex portion 32*c* are provided on the sliding portion 32. The locking hook 32*b* engages with the sheet feeding tray 21 in order to prevent the movable guide 3 from falling down. The convex portion 32*c* is provided in the groove 21*d* on the sliding contact surface 21*c*.

The operation portion 33 has a side surface 33*a* perpendicular to the placement surface 32*a* as in the guide surface 31*a*. The movable guide 3 is configured as follows. That is, when the operation portion 33 is pressed, a movement restriction of the movable guide 3 is deregulated so that the movable guide 3 is movable on the sliding contact surface 21*c* in the width direction H. Further, a projection portion 33*b*, and an axis support portion 33*c* are provided on the operation portion 33. The projection portion 33*b* projects to the side of the fixed guide 22. The axis support portion 33*c* supports the support member 4. The axis support portion 33*c* is formed on the projection portion 33*b* and made as a substantially cylindrical shape together with a part of the projection portion 33*b*.

Figure 5:
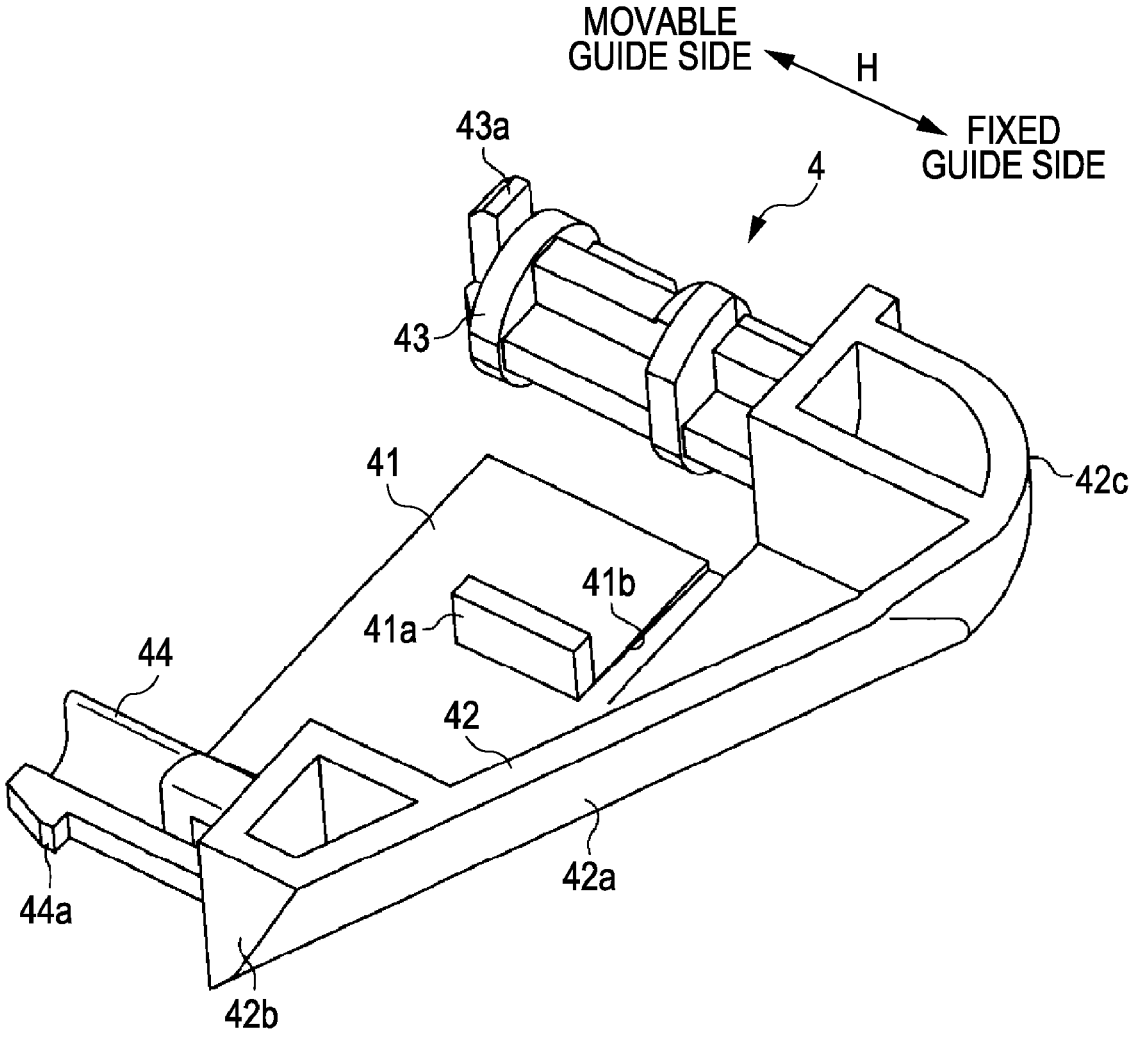
FIG. 5 is a perspective view illustrating a support member provided on the movable guide.
Figure 6:
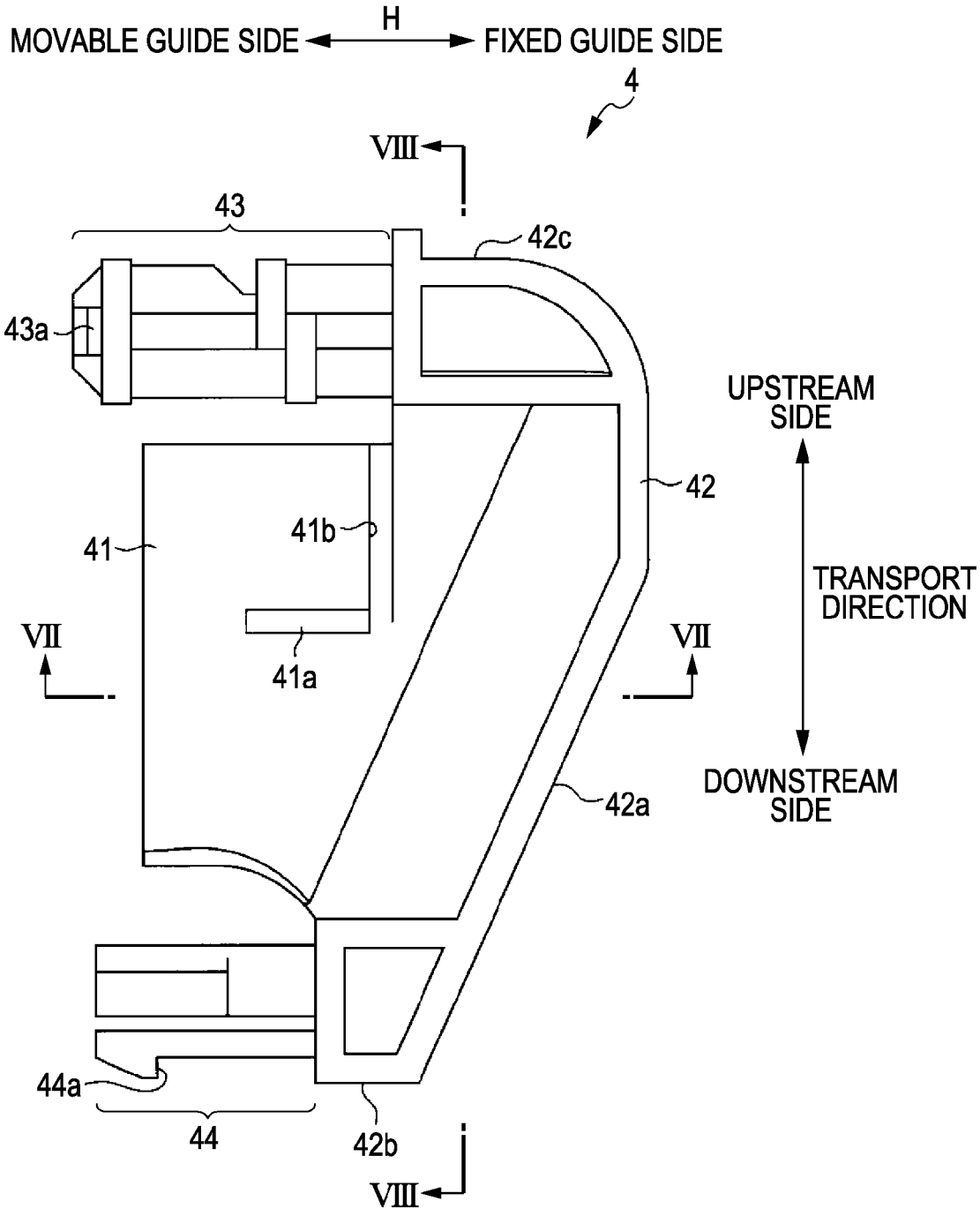
FIG. 6 is a plane view illustrating the support member provided on the movable guide.

As shown in FIG. 5 and FIG. 6, the support member 4 includes a plate base 41, a side wall 42, a rotation axis 43 and a support axis 44. The plate base 41 is flat in the width direction H and extends in the transport direction. The side wall 42 is arranged in a standing manner on the base 41. The rotation axis 43 and the support axis 44 project to the side of the movable guide 3 in the width direction H from a part of the side wall 42. The support member 4 in which the base 41, the side wall 42, the rotation axis 43 and the support axis 44 are integrally formed is configured of a single member made of a hard synthetic resin.

An engaging projection 41*a* and a guide groove 41*b* are provided on the base 41. The engaging projection 41*a* engages with a part of the torsion coil spring 5. The guide groove 41*b* guides a part of the torsion coil spring 5 to the engaging projection 41*a*. As shown in FIG. 6, the base 41 is formed such that the width thereof becomes progressively smaller from the upstream side toward the downstream side in the transport direction.

The side wall 42 is provided on an edge of the base 41 on the side of the fixed guide 22. The side wall 42 has a side surface 42*a*, a downstream side end surface 42*b* and an upstream side end surface 42*c*. The side surface 42*a* is opposed to the fixed guide 22 in the width direction H. The downstream side end surface 42*b* is provided on the downstream side of the side wall 42 in the transport direction. The upstream side end surface 42*c* is provided on the upstream side of the side wall 42 in the transport direction.

The side surface 42*a* which is extendedly arranged in the transport direction connects the downstream side end surface 42*b* and the upstream side end surface 42*c*. The upstream side end surface 42*c* is extendedly arranged on the side of the fixed guide 22 compared to the downstream side end surface 42*b*. Accordingly, the side surface 42*a* is extendedly arranged so as to project progressively to the side of the fixed guide 22 from the downstream side toward the upstream side in the transport direction.

Figure 7:
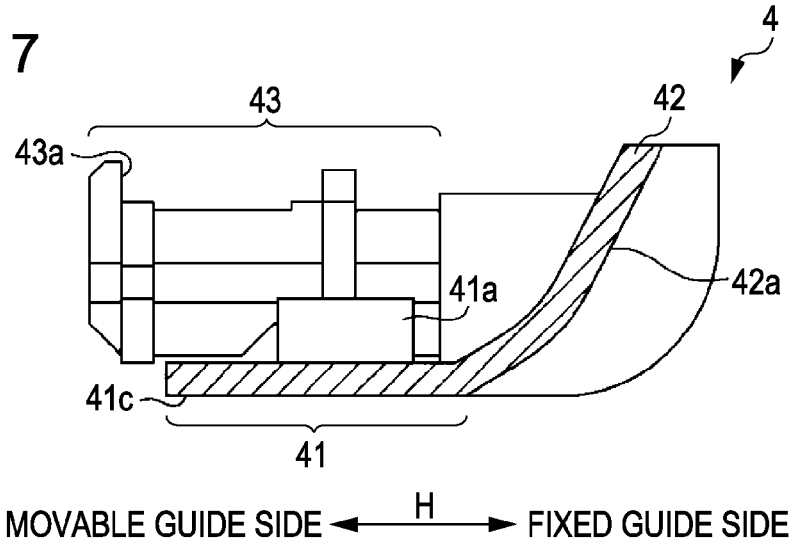
FIG. 7 is a cross sectional view illustrating a cross section cut along a line VII-VII in FIG. 6.

As shown in FIG. 5 and FIG. 7, the side surface 42*a* is provided in a slant manner. To be more specific, the side surface 42*a* is formed into a slant shape such that as a portion of the side surface 42*a* is nearer to the fixed guide 22 in the width direction H, a distance between the portion of the side surface 42*a* and the placement surface 32*a* is progressively increased. Thus, the slanted side surface 42*a* included in the support member 4 is provided so as to be opposed to the placement surface 32*a* of the movable guide 3.

Figure 8:
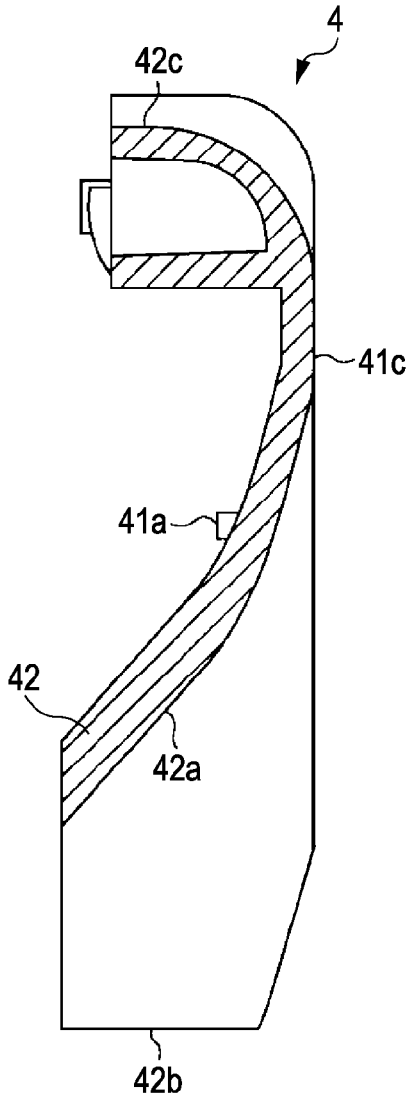
FIG. 8 is a cross sectional view illustrating a cross section cut along a line VIII-VIII in FIG. 6.

As shown in FIG. 8, the upstream side end surface 42*c* is connected to a bottom surface 41*c* with a curvature. The base 41 of the support member 4 has the bottom surface 41*c*. The bottom surface 41*c* is a flat surface provided so as to face the placement surface 32*a*. Accordingly, the upstream side end surface 42*c* of the side wall 42 is formed into a convex-spherical surface on the side of the fixed guide 22 in the width direction H and on the upstream side end in the transport direction.

The rotation axis 43 is formed so as to project to the side of the movable guide 3 from the side wall 42 on the upstream side in the transport direction. The support member 4 is provided so as to be rotatable with respect to the movable guide 3 because the rotation axis 43 is supported by the axis support portion 33*c*. A locking projection 43*a* is provided on the top end of the rotation axis 43 in order to prevent the rotation axis 43 from falling down from the axis support portion 33*c*. The locking projection 43*a* engages with the axis support portion 33*c* to lock the rotation axis 43 so as not to move to the side of the fixed guide 22. Note that an opening 33*d* is provided on the axis support portion 33*c* such that the axis support portion 33*c* is not interfered with the locking projection 43*a* when the rotation axis 43 is attached to the axis support portion 33*c* by inserting the rotation axis 43 from the side of the fixed guide 22.

The support axis 44 is formed into a semi-cylindrical form so as to project to the side of the movable guide 3 from the side wall 42 on the downstream side in the transport direction. The abutment roller 6 is rotatably supported by the support member 4 by attaching the abutment roller 6 to the support axis 44. A locking projection 44*a* is provided on the top end of the support axis 44 in order to prevent the abutment roller 6 from falling down from the support axis 44. The locking projection 44*a* locks the abutment roller 6 so as not to move to the side of the movable guide 3. The support axis 44 is formed so as to be elastically deformed. The abutment roller 6 is fitted into the support axis 44 from the side of the movable guide 3 by elastically deforming the support axis 44.

Figure 9:
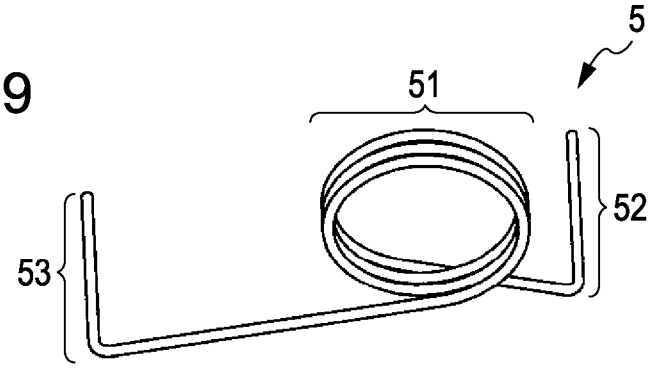
FIG. 9 is a perspective view illustrating an elastic member provided on the movable guide and the support member.

As shown in FIG. 9, the torsion coil spring 5 has a coil portion 51 which is made of a wire rod such as stainless steel and is formed by winding such a wire rod. One end 52 of the wire rod is formed into a shape capable of engaging with the movable guide 3. The other end 53 of the wire rod is formed into a shape capable of engaging with the support member 4. The coil portion 51 is fitted into the rotation axis 43 of the support member 4.

Figure 10A:
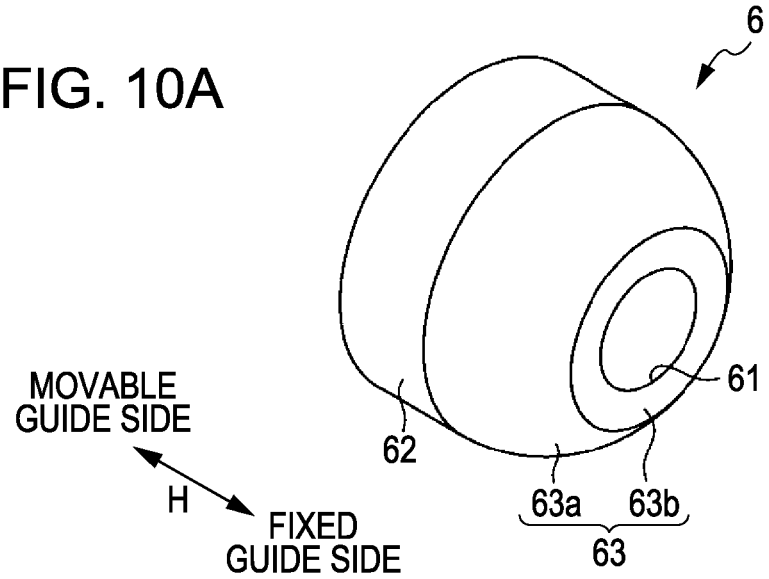
FIGS. 10A and 10B are perspective views illustrating an abutment member provided on the support member.
Figure 10B:
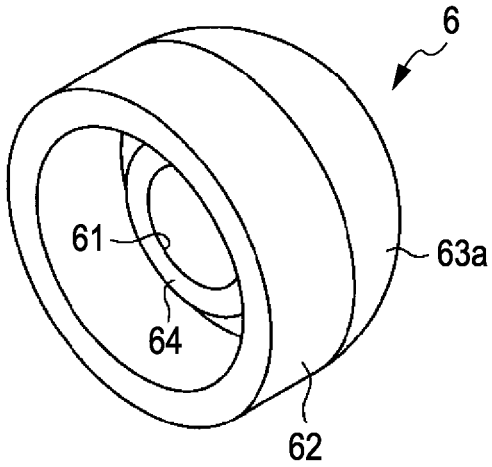

As shown in FIGS. 10A and 10B, the abutment roller 6 is a molded product made of a hard synthetic resin. A through-hole 61 to which the support axis 44 is inserted is formed on the abutment roller 6. The abutment roller 6 has an abutment surface 62, a convex-spherical surface 63*a* and an end surface 63*b*, and an engagement surface 64. The abutment surface 62 abuts against a surface of the sheet P and is formed into a cylindrical surface shape. The convex-spherical surface 63*a* and the end surface 63*b* serve as a side surface 63 opposed to the fixed guide 22 in the width direction H. The engagement surface 64 engages with the locking projection 44*a*.

The convex-spherical surface 63*a* forming the side surface 63 is provided so as to be slanted with respect to the placement surface 32*a*. To be more specific, the side surface 63 is formed into a slant shape such that as a portion of the side surface 63 is nearer to the fixed guide 22 in the width direction H, a distance between the portion of the side surface 63 and the placement surface 32*a* is progressively increased. The convex-spherical surface 63*a* is a surface of the abutment roller 6.

The diameter of the abutment roller 6 is progressively smaller toward the side of the fixed guide 22.

Figure 11:
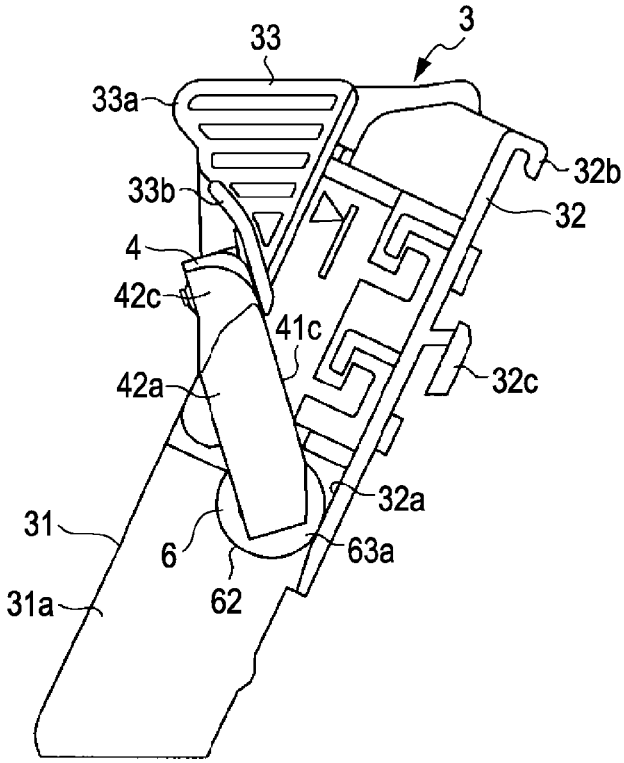
FIG. 11 is a side view illustrating a movable guide unit.
Figure 12:
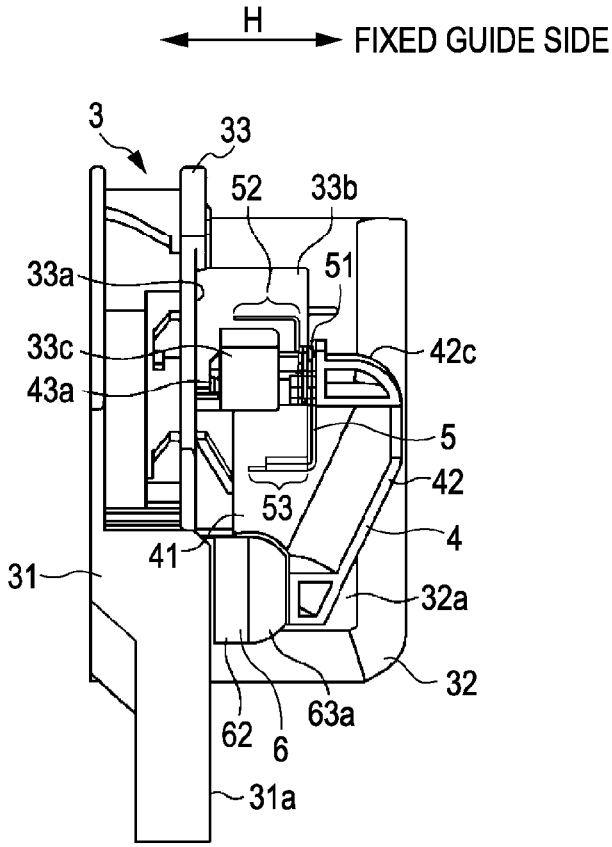
FIG. 12 is a front view illustrating the movable guide unit.

As shown in FIG. 11 and FIG. 12, the support member 4, the coil spring 5 and the abutment roller 6 are fixed to the movable guide 3. Further, a distance between the fixed guide 22 and the movable guide unit which is constituted by the movable guide 3, the support member 4, the coil spring 5 and the abutment roller 6 can be adjusted in the width direction H of the sheet P.

As described above, the sheet feeding apparatus 2 includes the placement surfaces 21*a*, 32*a*, the fixed guide 22, the movable guide 3 and the sheet feeding roller 25. The fixed guide 22 abuts against one side edge Pa of the sheet P. A distance between the movable guide 3 and the fixed guide 22 can be adjusted by moving the movable guide 3 and the movable guide 3 abuts against the other side edge Pb of the sheet P. The sheet feeding roller 25 abuts against a surface of the sheet P at a position which is at the side of the fixed guide 22 between the fixed guide 22 and the movable guide 3.

Next, a condition where the sheet P is transported while the sheet feeding roller 25 and the abutment roller 6 abut against the surface of the sheet P is described with reference to FIG. 13 and FIG. 14. A two-dot-dash line L in FIG. 13 indicates a transport path of a sheet P when one sheet P is placed on the placement surface 32*a*. A two-dot-dash line L in FIG. 14 indicates a transport path of an uppermost sheet P when a maximum number of sheets P which can be placed on the placement surface 32*a* are placed on the placement surface 32*a*.

Figure 13:
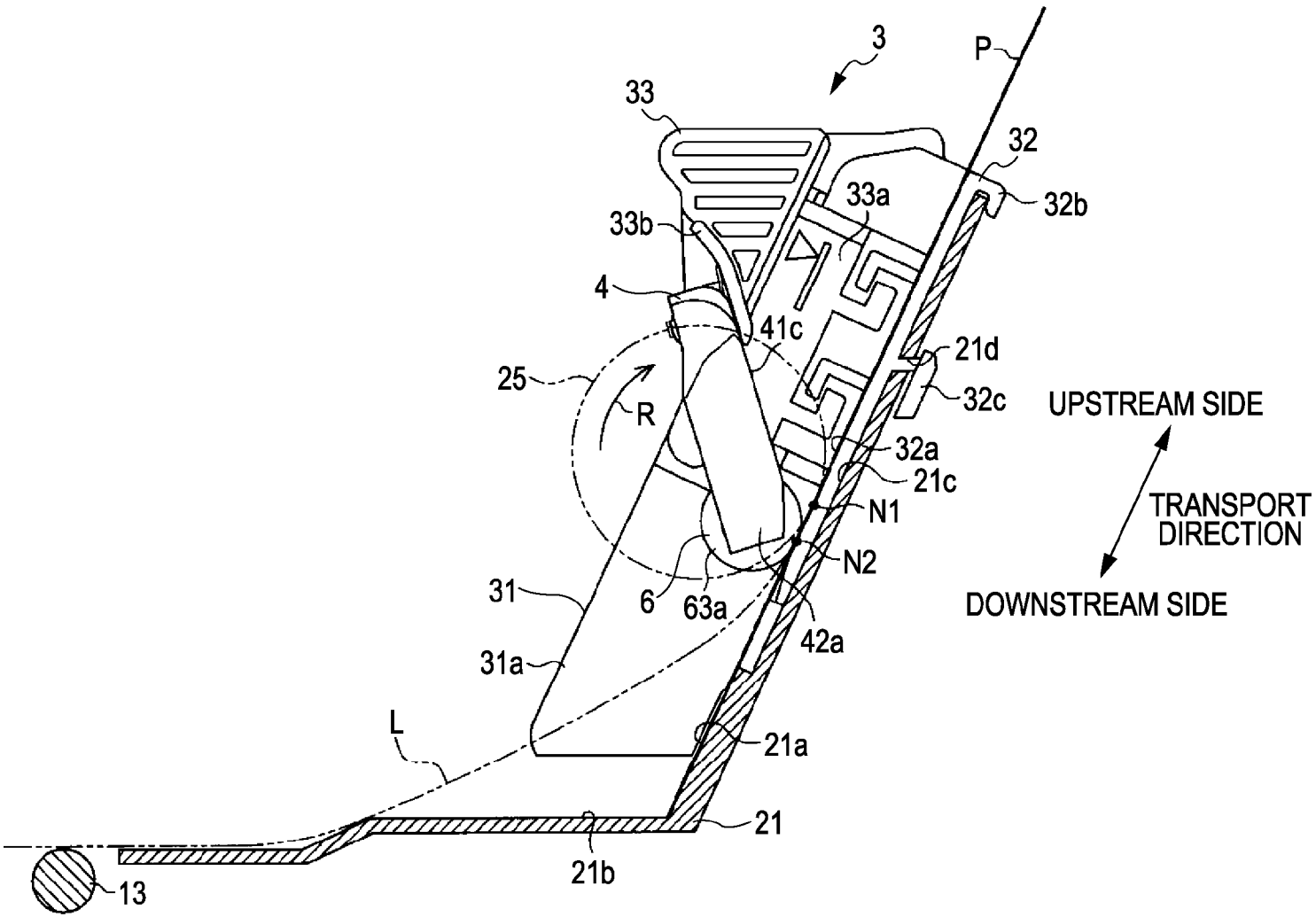
FIG. 13 is a side view illustrating the movable guide unit in a state where a small number of sheets are placed on a placement surface and is also a cross sectional view illustrating an image forming apparatus for explaining a condition in which the sheet is transported.
Figure 14:
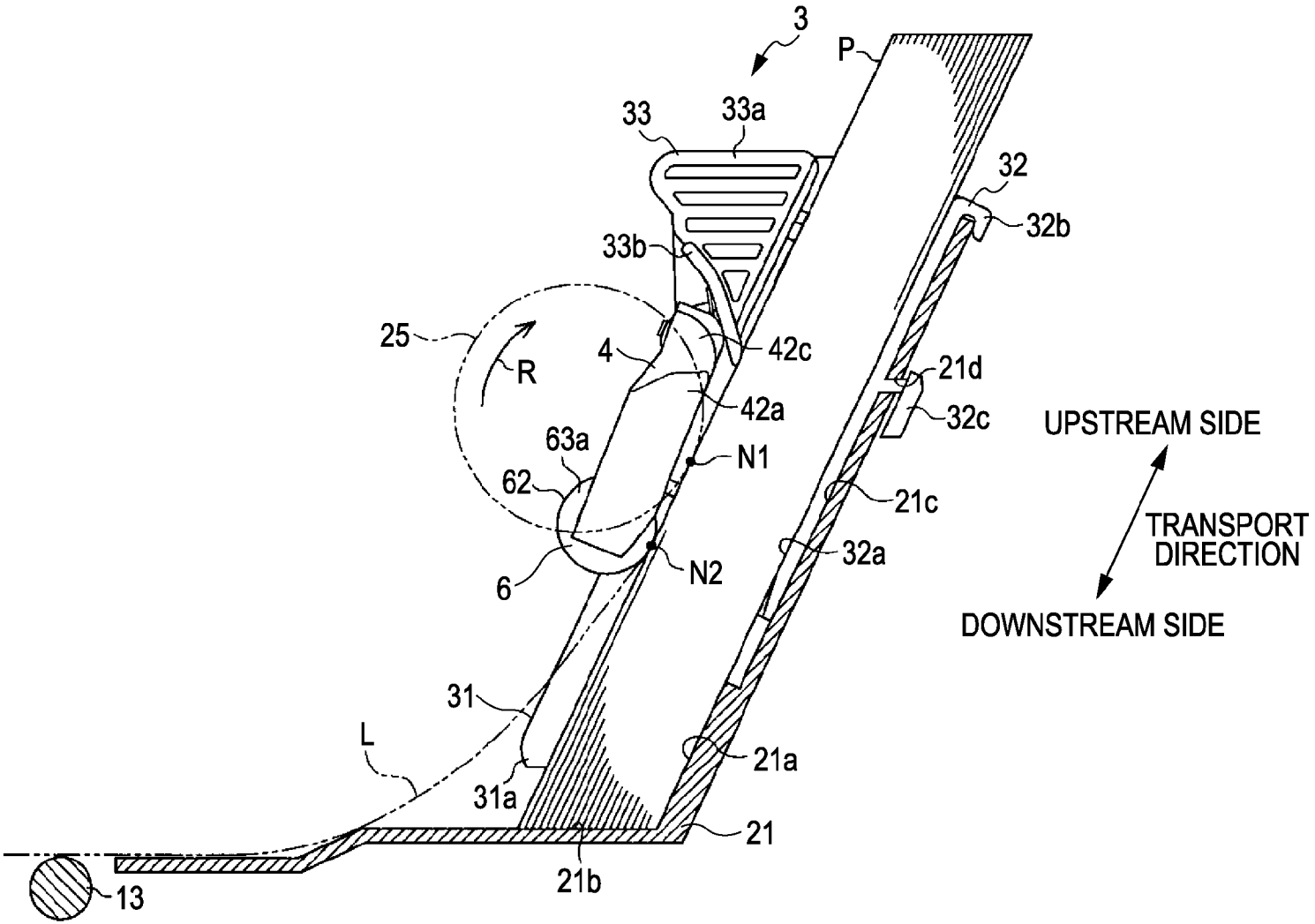
FIG. 14 is a side view illustrating the movable guide unit in a state where a large number of sheets are placed on the placement surface and is also a cross sectional view illustrating the image forming apparatus for explaining a condition in which the sheet is transported.

As shown in FIG. 13 and FIG. 14, the abutment roller 6 is biased toward the placement surface 32*a* together with the support member 4. In the embodiment, the abutment surface 62 of the abutment roller 6 is configured so as to abut against the surface of the sheet P, regardless of the number of sheets P placed on the placement surface 32*a*.

When the sheet feeding roller 25 rotates in the direction indicated by an arrow R, the sheet P is transported from the upstream side to the downstream side in the transport direction. Further, a Paper Feed (PF) roller 13 is also connected to the electric motor to rotate as in the sheet feeding roller 25. The PF roller 13 is provided on the downstream side in the transport direction with respect to the sheet feeding roller 25. Note that when the sheet P is transported to the image forming portion 11 fast, the PF roller 13 is preferably rotated such that a force act on the sheet P toward the upstream side in the transport direction. To be more specific, when the PF roller 13 abuts against a surface of the sheet P opposite to the surface against which the sheet feeding roller 25 abuts, the PF roller 13 is preferably rotated in the same direction as the sheet feeding roller 25.

In the embodiment, the abutment roller 6 is arranged such that an abutment point N2 is arranged further on the downstream side in the transport direction of the sheet P than an abutment point N1. The abutment point N1 is a position where the sheet feeding roller 25 abuts against the surface of the sheet P. The abutment point N2 is a position where the abutment roller 6 abuts against the surface of the sheet P. With such a configuration, the abutment roller 6 can abut against the surface of the sheet P with a force weaker than a force with which the sheet feeding roller 25 abuts against the surface of the sheet P so as to prevent the sheet P from being transported in a state in which the sheet P is tilted relative to the transport direction. Accordingly, the strength of the abutment roller 6 can be ensured without damaging the abutment roller 6 that is biased toward the placement surface 32*a*.

According to the embodiment, the following operation effects can be obtained.

Figure 15:
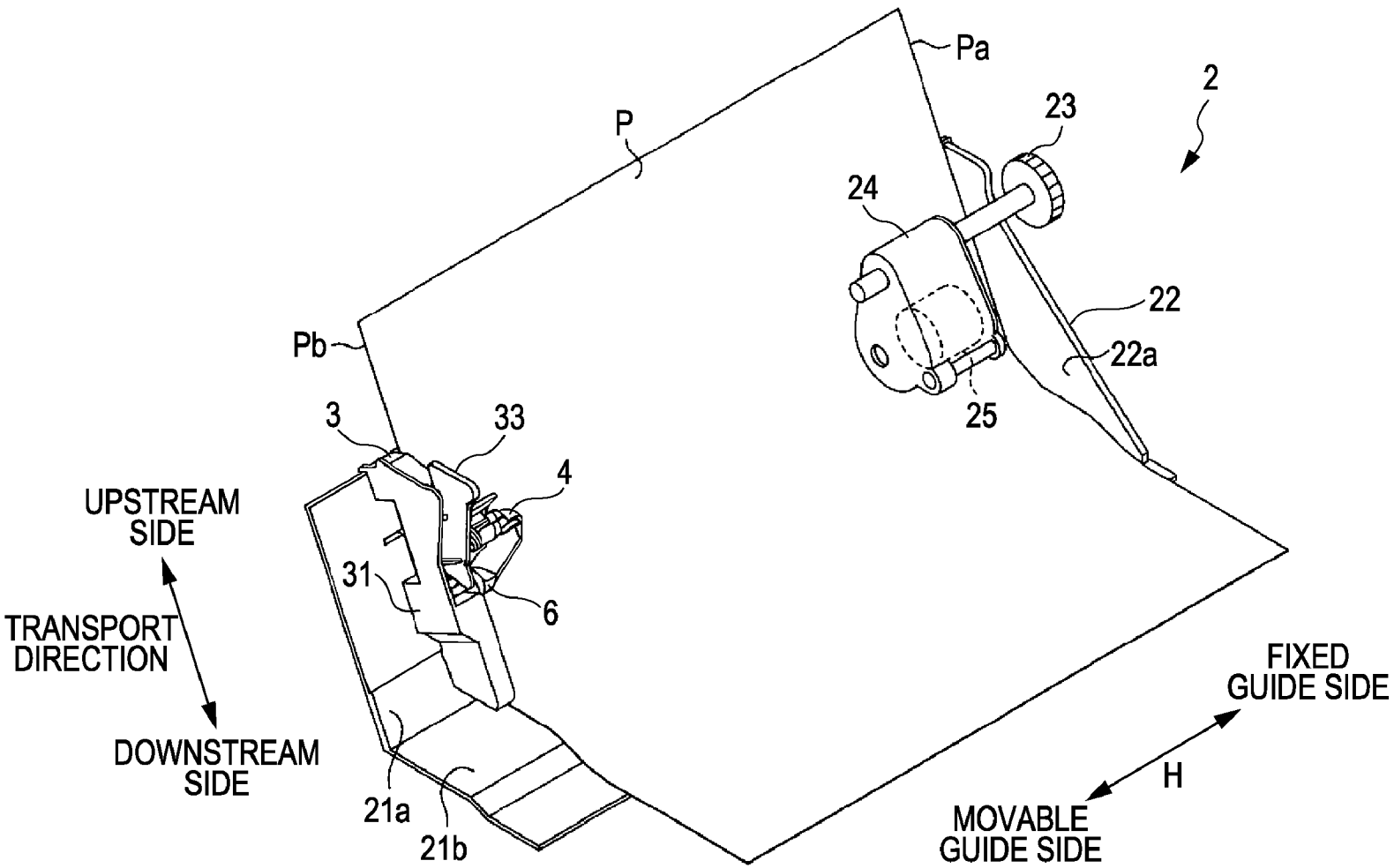
FIG. 15 is a view for explaining a condition where a sheet is transported and is also a perspective view illustrating the sheet feeding apparatus according to the embodiment of the invention.
Figure 16:
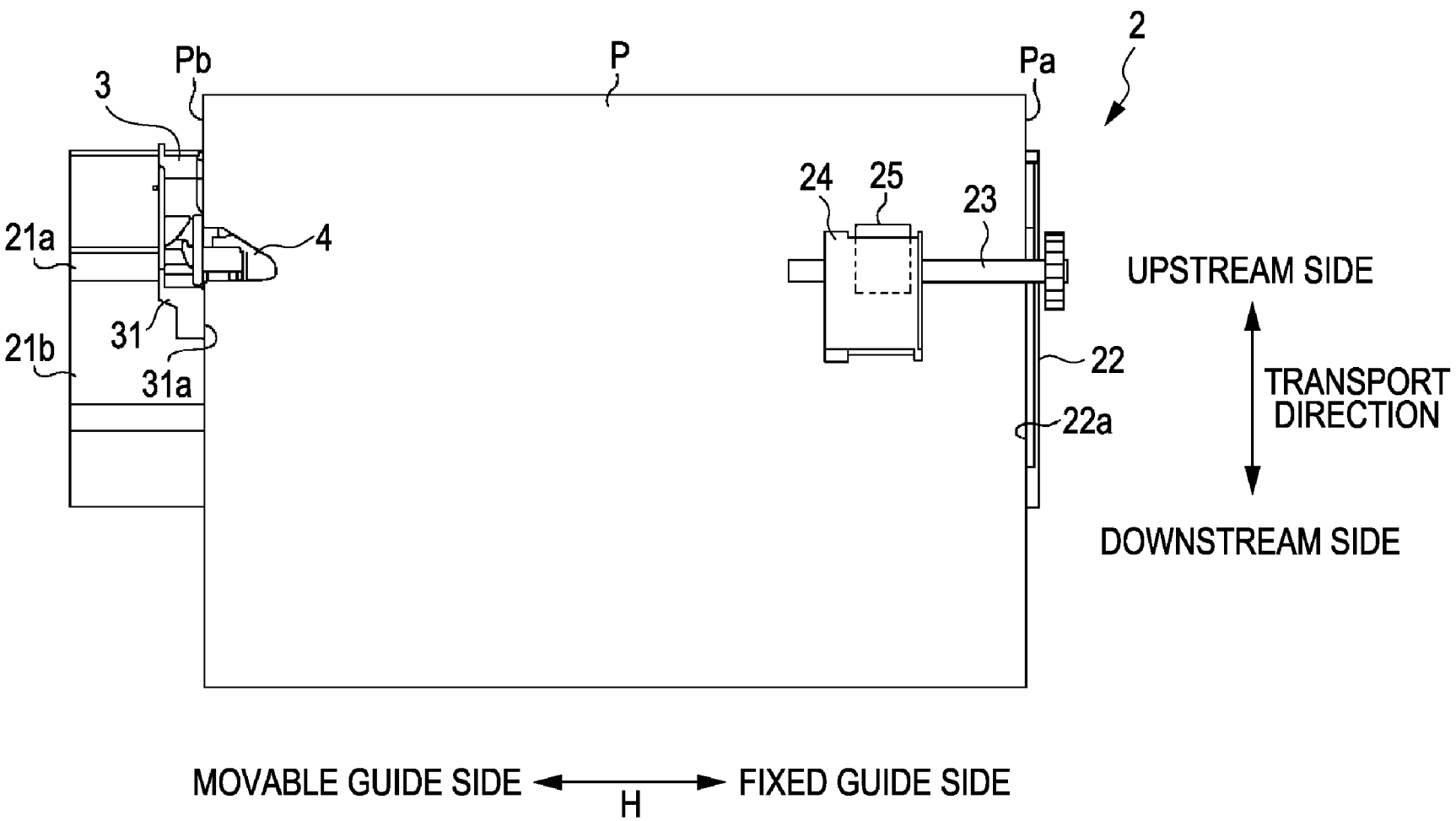
FIG. 16 is a view for explaining a condition where a sheet is transported and is also a plane view illustrating the sheet feeding apparatus according to the embodiment of the invention.
Figure 17:
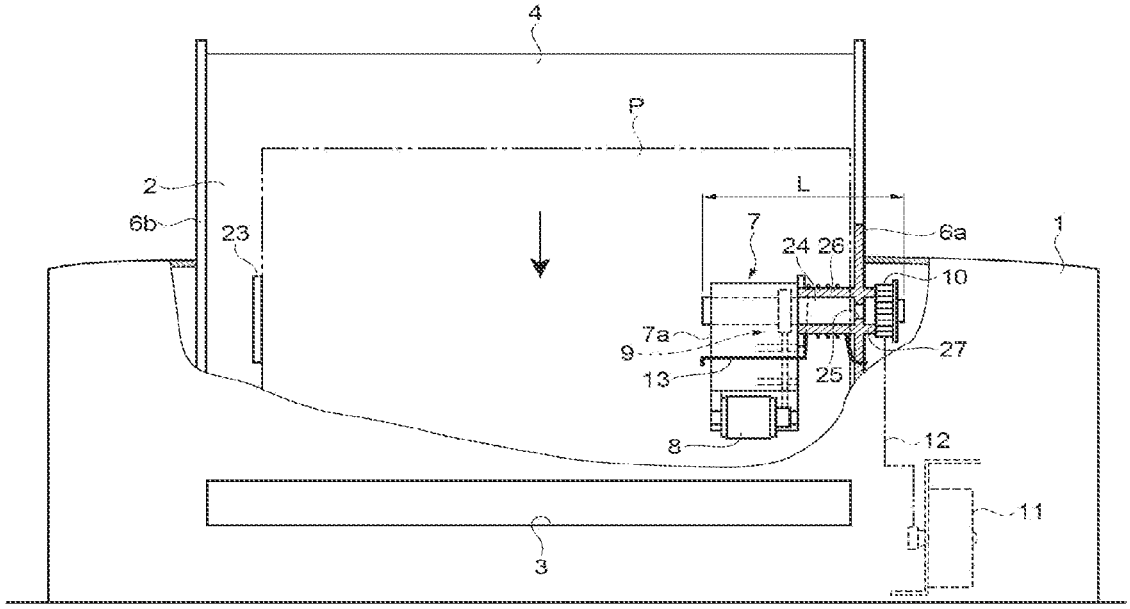
FIG. 17 PRIOR ART
FIG. 17 is a plane view illustrating a sheet feeding apparatus for explaining a condition in which a sheet is transported in a state where the sheet is tilted relative to the transport direction.
Figure 18:
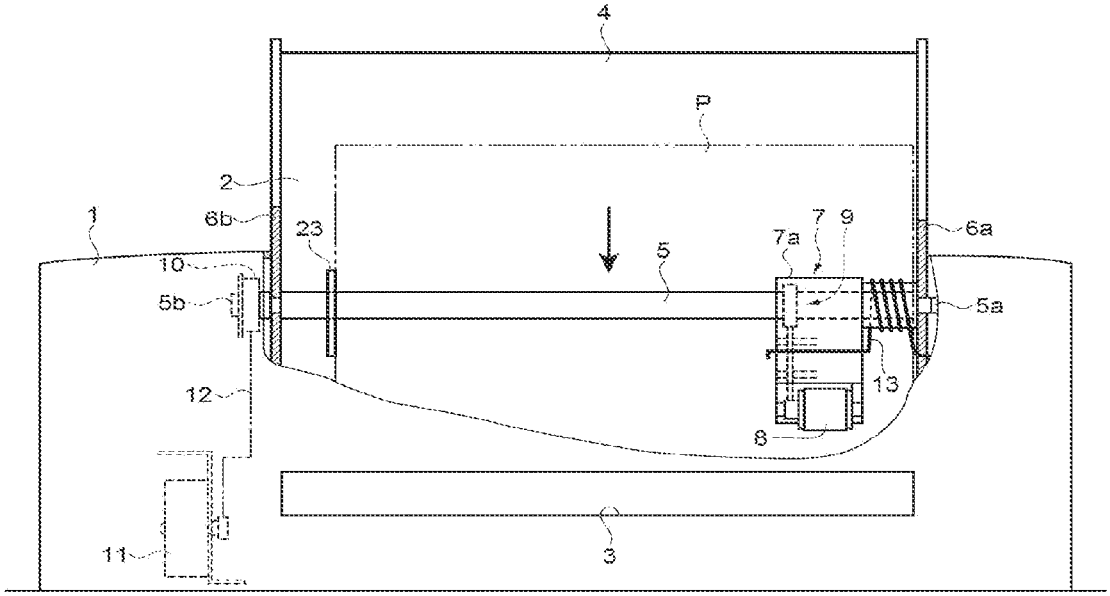
FIG. 18 PRIOR ART
FIG. 18 is a plane view illustrating the sheet feeding apparatus for explaining a condition in which a sheet is transported in a state where the sheet is tilted relative to the transport direction.

(1) The sheet feeding apparatus 2 includes the abutment roller 6 and the torsion coil spring 5. The abutment roller 6 is provided on the movable guide 3 and abuts against the surface of the sheet P. The torsion coil spring 5 biases the abutment roller 6 toward the placement surface 32*a*. Therefore, the surface of the sheet P can be pressed not only by the sheet feeding roller 25 located at the side of the fixed guide 22 but also by the abutment roller 6 located at the side of the movable guide 3. Accordingly, as shown in FIG. 15 and FIG. 16, even when the thick sheet P having high elasticity is transported, both edges of the sheet P in the width direction H can be suppressed from lifting off. In addition, the sheet P can be suppressed from being transported in a state in which the sheet P is tilted relative to the transport direction.

(2) The abutment roller 6 has the side surface 63 opposed to the fixed guide 22 in the width direction H. The side surface 63 is formed into a slant shape such that as a portion of the side surface 63 is nearer to the fixed guide 22 in the width direction H, a distance between the portion of the side surface 63 and the placement surface 32*a* is progressively increased. Therefore, when the sheet P is to be placed on the placement surface 32*a* toward which the abutment roller 6 is biased, the sheet P can be easily inserted between the placement surface 32*a* and the abutment roller 6 along the convex-spherical surface 63*a* which is the side surface 63 of the abutment roller 6, from the side of the fixed guide 22. Accordingly, even when the abutment roller 6 is biased toward the placement surface 32*a*, the sheet P that is inserted from the side of the fixed guide 22 and the convex-spherical surface 63*a* of the abutment roller 6 can be suppressed from being interfered with each other. Thus, the sheet P can be easily placed on the placement surface 32*a*.

(3) The abutment member which is provided on the movable guide 3 and abuts against the surface of the sheet P is the rotatable abutment roller 6. The side surface 63 is formed with the convex-spherical surface 63*a*. The diameter of the convex-spherical surface 63*a* of the abutment roller 6 is progressively smaller toward the side of fixed guide 22. Therefore, the sheet P can be inserted between the placement surface 32*a* and the abutment roller 6 along the convex-spherical surface 63*a* of the abutment roller 6. Further, friction impeding the transport of the sheet P can be suppressed from being generated.

(4) The sheet feeding apparatus 2 includes the support member 4 which rotatably supports the abutment roller 6 with respect to the movable guide 3. The abutment roller 6 is biased together with the support member 4 toward the placement surface 32*a*. Therefore, it is sufficient that the movable guide 3 for biasing the abutment roller 6 toward the placement surface 32*a* has a configuration for rotatably supporting the support member 4 (the movable guide 3 has an axis support portion 33*c* which supports the rotation axis 43 provided on the support member 4). Accordingly, a configuration which directly supports the abutment roller 6 is not required to be formed on the movable guide 3. As a result, for example, an elongate hole or the like which enables the abutment roller 6 biased toward the placement surface 32*a* to be movable is not required providing on the movable guide 3. Therefore, a smaller movable guide 3 can be realized.

(5) The support member 4 has the side surface 42*a* opposed to the fixed guide 22 in the width direction H. The side surface 42*a* is formed into a slant shape such that as a portion of the side surface 42*a* is nearer to the fixed guide 22 in the width direction H, a distance between the portion of the side surface 42*a* and the placement surface 32*a* is progressively increased. Therefore, when the sheet P is inserted between the placement surface 32*a* and the abutment roller 6, the sheet P can be guided between the placement surface 32*a* and the abutment roller 6 along the side surface 42*a* of the support member 4 from the side of the fixed guide 22.

(6) The side surface 42*a* of the support member 4 is extendedly arranged so as to project progressively to the side of the fixed guide 22 from the downstream side toward the upstream side in the transport direction of the sheet P. Therefore, the sheet P can be reliably guided between the placement surface 32*a* and the abutment roller 6 in comparison with a case where the side surface 42*a* of the support member 4 is extended in parallel in the transport direction.

(7) The support member 4 has the bottom surface 41*c* so as to face the placement surface 32*a*, the upstream side end surface 42*c* provided on the upstream side in the transport direction of the sheet P. The upstream side end surface 42*c* is connected to the bottom surface 41*c* in a curvature manner. Therefore, the sheet can be easily inserted between the placement surface 32*a* and the support member 4 from the upstream side of the support member 4 in the transport direction.

(8) The elastic member which biases the abutment roller 6 toward the placement surface 32*a* is the torsion coil spring 5 attached to the movable guide 3. Therefore, the abutment roller 6 can be biased toward the placement surface 32*a* by utilizing a torsion moment of the torsion coil spring 5.

(9) Because the printer 1 includes the above sheet feeding apparatus 2 and the image forming portion 11 which forms an image on the sheet P, the effects described in the above 1 to 8 can be obtained. Further, the sheet P can be suppressed from being transported in a state in which the sheet P is tilted relative to the transport direction so that the image is appropriately formed on the sheet P.

It is to be noted that the above embodiment may be modified as follows.

In the embodiment, the sheet feeding apparatus 2 can be applied to an image reading apparatus such as a scanner. That is, according to the image reading apparatus including the sheet feeding apparatus 2 of the above embodiment and the image reading portion which reads an image formed on the sheet P, the same operation effects described in the above 1 to 9 can be obtained. Therefore, the image can be appropriately read.

In the above embodiment, the abutment roller 6 may be biased toward the placement surface 32*a* by another elastic member such as a compression spring or a plate spring.

A shape of the support member 4 may be appropriately changed. Further, the abutment roller 6 may be provided on the movable guide 3 without using the support member 4. In this case, the abutment roller 6 is supported by the movable guide 3 or the elastic member attached to the movable guide 3.

In the embodiment, the abutment member is not necessarily required to rotate and a molded resin article other than the roller, which does not rotate, may be used as an abutment member.

What is claimed is:

1. A sheet feeding apparatus comprising:

a placement surface on which a sheet to be transported is placed;

a fixed guide which abuts against one side edge of the sheet in the width direction to guide transport of the sheet;

a movable guide which abuts against the other side edge of the sheet in the width direction to guide transport of the sheet while a distance between the movable guide and the fixed guide in the width direction of the sheet is adjustable;

a sheet feeding roller which abuts against a surface of the sheet at a position which is at the side of the fixed guide between the fixed guide and the movable guide and rotationally drives to transport the sheet;

an abutment member which is provided on the movable guide and abuts against the surface of the sheet;

a support member which rotatably supports the abutment member with respect to the movable guide, wherein the support member includes a side surface opposed to the fixed guide and is arranged to project progressively to the fixed side from a downstream side to an upstream side, wherein the side surface of the support member is slanted such that as a portion of the side surface becomes nearer to the fixed quide in the width direction, a distance between the portion of the side surface of the support member and the placement surface is increased; and an elastic member which biases the abutment member toward the placement surface, wherein the abutment member has a side surface opposed to the fixed guide in the width direction, and the side surface is configured such that as a portion of the side surface becomes nearer to the fixed guide in the width direction, a distance between the portion of the side surface and the placement surface is increased.

2. The sheet feeding apparatus according to claim 1, wherein the abutment member is a rotatable roller, and the side surface is formed with a convex-spherical surface of the roller of which the diameter is progressively smaller toward the side of the fixed guide.

3. The sheet feeding apparatus according to claim 1, wherein the abutment member is biased together with the support member toward the placement surface.

4. The sheet feeding apparatus according to claim 3, wherein the support member has an upstream side end surface, a downstream side end surface, and the side surface opposed to the fixed guide in the width direction, and the side surface is formed into a slant shape between the upstream side end surface and the downstream side end surface such that as a portion of the side surface is nearer to the fixed guide in the width direction, a distance between the portion of the side surface and the placement surface is progressively increased.

5. The sheet feeding apparatus according to claim 4, wherein the support member comprises a support axis portion to support the support member on the movable guide and a rotation axis portion, the support axis portion and the rotation axis portion integrally formed in the support member.

6. The sheet feeding apparatus according to claim 3, wherein the support member has a bottom surface provided so as to face the placement surface, and the upstream side end surface which is provided on the upstream side in the transport direction of the sheet, and the upstream side end surface is connected to the bottom surface in a curvature manner.

7. The sheet feeding apparatus according to claim 1, wherein the elastic member is a torsion coil spring attached to the movable guide.

8. An image forming apparatus comprising:

an image forming portion which forms an image on a sheet; and a sheet feeding apparatus that includes:

a placement surface on which the sheet is placed to be transported;

a fixed guide which abuts against one side edge of the sheet in the width direction to guide transport of the sheet;

a movable guide which abuts against the other side edge of the sheet in the width direction to guide transport of the sheet while a distance between the movable guide and the fixed guide in the width direction of the sheet is adjustable;

a sheet feeding roller which abuts against a surface of the sheet at a position which is at the side of the fixed guide between the fixed guide and the movable guide and rotationally drives to transport the sheet;

an abutment member which is provided on the movable guide and abuts against the surface of the sheet;

a support member which rotatably supports the abutment member with respect to the movable guide, wherein the support member includes a side surface opposed to the fixed guide and is arranged to project progressively to the fixed side from a downstream side to an upstream side, wherein the side surface of the support member is slanted such that as a portion of the side surface becomes nearer to the fixed guide in the width direction, a distance between the portion of the side surface of the support member and the placement surface is increased; and an elastic member which biases the abutment member toward the placement surface, wherein the abutment member has a side surface opposed to the fixed guide in the width direction, and the side surface is configured such that as a portion of the side surface becomes nearer to the fixed guide in the width direction, a distance between the portion of the side surface and the placement surface is increased.

9. The image forming apparatus according to claim 8, wherein the abutment member is a rotatable roller, and the side surface is formed with a convex-spherical surface of the roller of which the diameter is progressively smaller toward the side of the fixed guide.

10. The image forming apparatus according to claim 8, wherein the abutment member is biased together with the support member toward the placement surface.

11. The image forming apparatus according to claim 10, wherein the side surface of the support member is opposed to the fixed guide in the width direction, and the side surface is configured such that as a portion of the side surface becomes nearer to the fixed guide in the width direction, a distance between the portion of the side surface and the placement surface is progressively increased.

12. The image forming apparatus according to claim 11, wherein the support member comprises a support axis portion to support the support member on the movable guide and a rotation axis portion, the support axis portion and the rotation axis portion integrally formed in the support member.

13. The image forming apparatus according to claim 10, wherein the support member has a bottom surface provided so as to face the placement surface, and an upstream side end surface which is provided on the upstream side in the transport direction of the sheet, and the upstream side end surface is connected to the bottom surface in a curvature manner.

14. The image forming apparatus according to claim 8, wherein the elastic member is a torsion coil spring attached to the movable guide.

15. An image reading apparatus comprising:

an image reading portion which reads an image on a sheet; and a sheet feeding apparatus that includes:

a placement surface on which the sheet is placed to be transported;

a fixed guide which abuts against one side edge of the sheet in the width direction to guide transport of the sheet;

a movable guide which abuts against the other side edge of the sheet in the width direction to guide transport of the sheet while a distance between the movable guide and the fixed guide in the width direction of the sheet is adjustable;

a sheet feeding roller which abuts against a surface of the sheet at a position which is at the side of the fixed guide between the fixed guide and the movable guide and rotationally drives to transport the sheet;

an abutment member which is provided on the movable guide and abuts against the surface of the sheet;

a support member which rotatably supports the abutment member with respect to the movable guide, wherein the support member includes a side surface opposed to the fixed guide and is arranged to project progressively to the fixed side from a downstream side to an upstream side, wherein the side surface of the support member is slanted such that as a portion of the side surface becomes nearer to the fixed guide in the width direction, a distance between the portion of the side surface of the support member and the placement surface is increased; and an elastic member which biases the abutment member toward the placement surface, wherein the abutment member has a side surface opposed to the fixed guide in the width direction, and the side surface is configured such that as a portion of the side surface becomes nearer to the fixed guide in the width direction, a distance between the portion of the side surface and the placement surface is increased.

16. The image reading apparatus according to claim 15, wherein the abutment member is a rotatable roller, and the side surface is formed with a convex-spherical surface of the roller of which the diameter is progressively smaller toward the side of the fixed guide.

17. The image reading apparatus according to claim 15, wherein the abutment member is biased together with the support member toward the placement surface.

18. The image reading apparatus according to claim 17, wherein the support member has a side surface opposed to the fixed guide in the width direction, and the side surface is configured such that as a portion of the side surface becomes nearer to the fixed guide in the width direction, a distance between the portion of the side surface and the placement surface is progressively increased.

19. The image reading apparatus according to claim 18, wherein the support member comprises a support axis portion to support the support member on the movable guide and a rotation axis portion, the support axis portion and the rotation axis portion integrally formed in the support member.

20. The image reading apparatus according to claim 17, wherein the support member has a bottom surface provided so as to face the placement surface, and an upstream side end surface which is provided on the upstream side in the transport direction of the sheet, and the upstream side end surface is connected to the bottom surface in a curvature manner.

21. The image reading apparatus according to claim 15, wherein the elastic member is a torsion coil spring attached to the movable guide.

* * * * *